US007748564B2

(12) United States Patent
Kinugasa et al.

(10) Patent No.: US 7,748,564 B2
(45) Date of Patent: Jul. 6, 2010

(54) LATCHING STRUCTURE FOR COVER AND TRANSFER TOOL

(75) Inventors: Shuji Kinugasa, Osaka (JP); Kinya Matsushita, Osaka (JP); Hideto Shima, Kyoto (JP)

(73) Assignee: Kokuyo S&T Co., Ltd. (JP)

( * ) Notice: Subject to any disclaimer, the term of this patent is extended or adjusted under 35 U.S.C. 154(b) by 786 days.

(21) Appl. No.: 11/385,871

(22) Filed: Mar. 22, 2006

(65) Prior Publication Data

US 2006/0244558 A1 Nov. 2, 2006

(30) Foreign Application Priority Data

Apr. 27, 2005 (JP) ..... P2005-130452

(51) Int. Cl.
*B65D 43/14* (2006.01)
*B65D 43/16* (2006.01)

(52) U.S. Cl. ..... 220/833; 220/832

(58) Field of Classification Search ..... 220/821, 220/820, 835, 834, 833, 832, 831, 840, 841, 220/836, 810; 206/411; 156/574, 527, 523; D19/67; 225/43, 50, 48, 39; 292/DIG. 11, 292/DIG. 38, DIG. 53; *B43L 19/00; B65H 26/00*
See application file for complete search history.

(56) References Cited

U.S. PATENT DOCUMENTS 2,889,975 A * 6/1959 Hanlon ..... 225/19
4,447,482 A * 5/1984 Heinzelman et al. ..... 428/42.3
4,700,835 A * 10/1987 Rognsvoog, Jr. ..... 206/411
4,718,971 A * 1/1988 Summers ..... 156/540
4,849,064 A * 7/1989 Manusch et al. ..... 156/577
4,851,076 A * 7/1989 Manusch et al. ..... 156/577
5,076,460 A * 12/1991 Hussell ..... 220/4.22
5,394,644 A * 3/1995 Ballu ..... 47/1.01 R
5,486,389 A * 1/1996 Gerber ..... 428/41.9
D369,385 S * 4/1996 Lapointe ..... D19/69
5,707,482 A * 1/1998 Fusselman ..... 156/577
5,770,007 A * 6/1998 Czech et al. ..... 156/540
5,897,742 A * 4/1999 Semmler ..... 156/577
6,386,416 B1 * 5/2002 Dunshee et al. ..... 225/49
6,510,884 B1 * 1/2003 Chan ..... 156/527
2002/0056526 A1 * 5/2002 Kelders et al. ..... 156/577
2002/0088554 A1 * 7/2002 Bouveresse et al. ..... 156/577
2002/0129719 A1 * 9/2002 Tamai et al. ..... 101/33
2003/0037886 A1 * 2/2003 Kobayashi ..... 156/577

(Continued)

FOREIGN PATENT DOCUMENTS

DE 3719452 C1 * 7/1988

(Continued)

*Primary Examiner*—Anthony Stashick
*Assistant Examiner*—Robert J Hicks
(74) *Attorney, Agent, or Firm*—Banner & Witcoff, Ltd.

(57) ABSTRACT

A transfer tool has a transfer tool main body including a case and a transfer head for applying tape. It also may include a cover housing a rotating shaft configured to engage the case and enable the cover to rotate about the rotating shaft such that the transfer head is exposed when the cover is in an open position and the transfer head is covered by the cover in a closed position. The transfer tool also may includes a latching structure for latching the cover and the transfer tool main body. The latching structure may be located proximate to the rotating shaft and may include complementary concave and convex portions housed on the transfer tool main body and the cover. The cover may be latched to the transfer tool main body in the open, closed and other predetermined positions.

12 Claims, 9 Drawing Sheets

U.S. PATENT DOCUMENTS

2004/0118523 A1* 6/2004 Stade ..... 156/579
2005/0155717 A1* 7/2005 Mitsui et al. ..... 156/577

FOREIGN PATENT DOCUMENTS

JP 2003-054190 2/2003
JP 2006001236 A * 1/2006
JP 2006051663 A * 2/2006
JP 2006181983 A * 7/2006
JP 2006248183 A * 9/2006

* cited by examiner (a)

(b)

(a)

(b)

(a)

(b)

(a)

(b)

(a)

(b)

(c)

(a)

(b)

(c)

LATCHING STRUCTURE FOR COVER AND TRANSFER TOOL

BACKGROUND OF THE INVENTION

1. Field of the Invention

The present invention relates to a latching structure for latching a cover attached to a supporting body at a predetermined position.

2. Description of the Related Art

There have conventionally been suggested structures for latching cover attached to supporting body in a rotating manner at predetermined positions.

For instance, taking a transfer tool as an example, there is disclosed a case as in Japanese Patent Laid-Open Publication No. 2003-54190 in which a cover is supported in a rotating manner between an open position in which a transfer head is exposed when the transfer tool is in use and a closed position in which the transfer head is covered when the transfer tool is not in use.

However, it is necessary to provide a protrusion at a position of the transfer tool main body proximate of the transfer head in order to latch the cover at the predetermined position or to provide another particular structure for accurately latching the cover to the transfer tool main body. Accordingly, the structure of the transfer tool main body or the cover will become complicated which consequently results in increased manufacturing costs of the transfer tool itself.

Such problems are not limited to transfer tools only but similar problems may arise in structures in which a cover is attached to a supporting body in a rotating manner.

SUMMARY OF THE INVENTION

The present invention has been made in view of such inconveniences, and it provides a latching structure of simplified structure but capable of certainly latching the cover and a transfer tool employing the latching structure for cover.

For achieving the object, the present invention has devised the following means. More particularly, the latching structure for a cover according to the present invention is arranged in that it includes a supporting body and a cover attached to the supporting body in a rotating manner, the latching structure for latching the cover at a predetermined position, wherein latching means through which the cover is latched to the supporting body is provided proximate of a rotating shaft around which the cover rotates or at the rotating shaft itself.

With such configuration, by providing the latching means at the rotating shaft itself at which the supporting body at least contacts the cover in order to rotatably attach both, or proximate thereof, it will be possible to effectively avoid the necessity of providing a particular means for maintaining the position of the cover at different spots of the cover and the supporting body. With such configuration, specifications for the supporting body and the cover other than that of the location of the rotating shaft will not be limited, and the flexibility of design for arranging the cover and the supporting body can be suitably improved.

For certainly positioning the cover while stabilizing operations of the rotating shaft, the latching means is desirably comprised of a concave portion provided at one of the supporting body or the cover proximate of the rotating shaft and a convex portion provided at the other one thereof that fits into the concave portion at the predetermined position.

For determining a plurality of positions for latching the cover through a simple structure, it is desirable to dispose a plurality of concave portions concentrically around the rotating shaft when seen in a plan view.

For stably maintaining the position at which the cover is latched, it is desirable to provide a plurality of the convex portions, wherein the plurality of convex portions are arranged to respectively fit into the plurality of concave portions.

On the other hand, when the latching means is provided at the rotating shaft itself and the supporting body and the cover are positioned through the rotating portion only, it is preferable that the latching means is comprised of a inclined shaft provided at one of the supporting body and the cover and extending to deflect towards a predetermined direction when seen in a plan view and an elongated hole provided at the other one thereof to accommodate the inclined shaft therein, and that the structure is arranged in that it latches the cover with respect to the supporting body at a predetermined position at which a inclined direction of the inclined shaft and a longitudinal direction of the elongated hole coincide.

For suitably latching the cover, the supporting body and the cover shall be made of resin so that bending, which is a characteristic of resin materials, can be effectively utilized for suitably latching the supporting body and the cover, and also easily unlatching the same from the latched condition.

For suitably applying the above-described cover latching structure to a transfer tool, it is desirable that the supporting body is comprised by the transfer tool main body, with the cover being attached to the transfer tool main body so that it may cover a transfer head provided at the transfer tool main body, and that the latching means is arranged to assume an open position at which the transfer head is exposed from the cover and a closed position at which the transfer head is covered.

According to the present invention, by providing the latching means at the rotating shaft itself at which the supporting body at least contacts the cover in order to rotatably attach both, or proximate thereof, it will be possible to effectively avoid the necessity of providing a particular means for maintaining the position of the cover at different spots of the cover and the supporting body. With such configuration, specifications for the supporting body and the cover other than that of the location of the rotating shaft will not be limited and the flexibility of design for arranging the cover and the supporting body can be suitably improved, and the structure of the supporting body and the cover can be simplified so as to achieve reductions in manufacturing costs.

Particularly, when employing the cover latching structure according to the present invention to a transfer tool, it is possible to provide a transfer tool that certainly latches the cover and that is of reduced manufacturing costs.

DETAILED DESCRIPTION OF THE PREFERRED EMBODIMENTS

Figure 1:
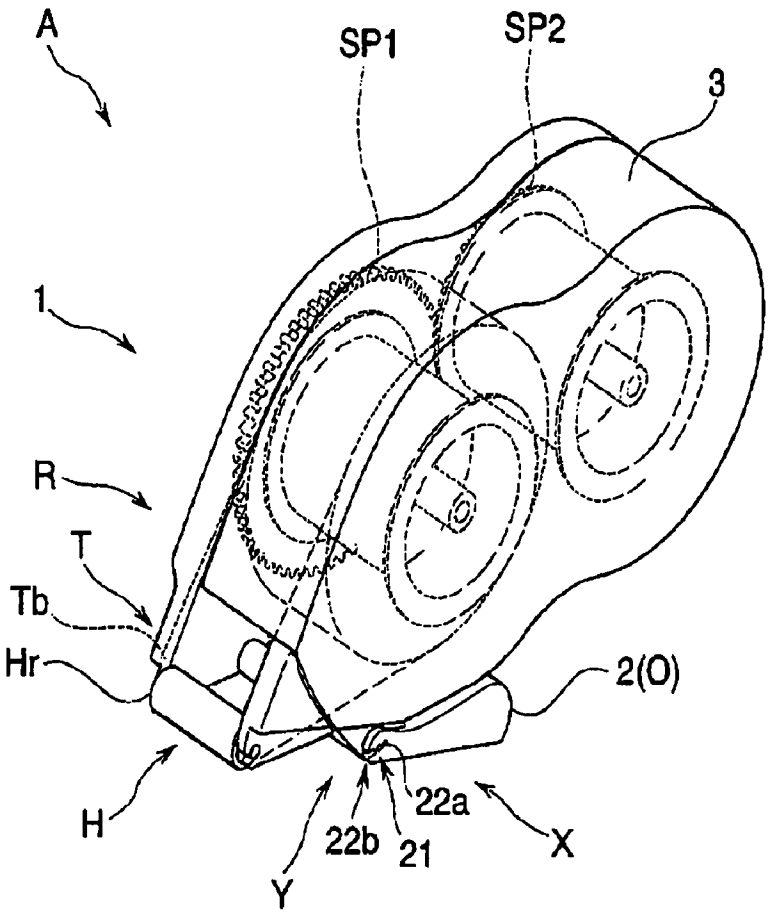
FIG. 1 is an external appearance related to a first embodiment of the present invention.

An embodiment of the present invention will now be explained while referring to the drawings.

A transfer tool A employing the latching structure X comprising the cover latching structure according to the present embodiment is shown in FIGS. 1 to 4.

The transfer tool A is mainly comprised of a transfer tool main body 1 corresponding a supporting body and a cover 2 attached to the transfer tool main body 1 in a rotating manner.

Here, the transfer tool A employing the mounting structure X of the cover 2 according to the present embodiment includes the transfer tool main body 1 and the cover 2 attached to the transfer tool main body 1 in a rotating manner and employs the cover latching structure X for latching the cover 2 with respect to a predetermined position, and is arranged in that latching means Y for latching the cover 2 with respect to the transfer tool main body 1 is provided proximate of a rotating shaft 21 to be explained later around which the cover 2 rotates.

The transfer tool A according to the present embodiment is further arranged in that the cover 2 is attached to the transfer tool main body 1 such that a transfer head H to be explained later included in the transfer tool main body 1 is covered, and in that the latching means Y is arranged to assume an open position O at which the transfer head H is exposed from the cover 2 and a closed position C at which the transfer head H is covered.

Detailed structures of the transfer tool A will now be explained.

Figure 2:
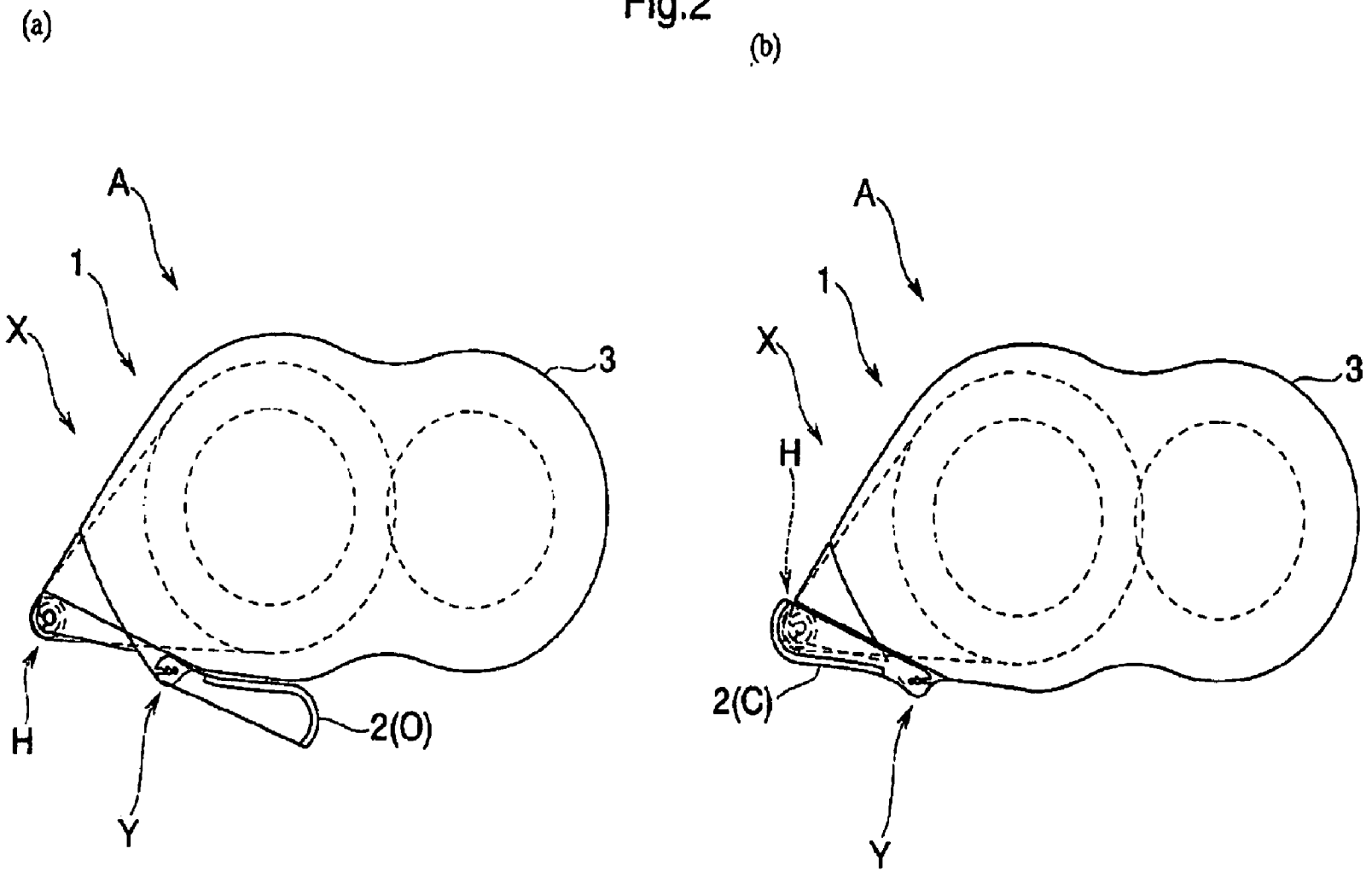
FIG. 2 is a side view related to the above embodiment.

As shown in FIGS. 1 and 2, the transfer tool main body is comprised of a case 3 mainly made of resin and a transfer object holding portion R accommodated inside of the case 3.

As shown in FIGS. 1 and 2, the case 3 comprises an outer shape of the transfer tool 1 itself and assumes a halved structure mainly made of two parts. An aperture is provided such that the transfer head H to be explained later can be exposed.

As shown in FIG. 1, the transfer object holding portion R is comprised with a unwinding spool SP1 that accommodates as the transfer object, for instance, a transfer tape T adhered with glue Tb on one side thereof, a winding spool SP2, and a transfer head H including a transfer roller Hr for pressing the transfer tape T onto an object of transfer such as paper. Note that in the present embodiment, the unwinding spool SP1, the winding spool SP2 and the transfer head H that comprise the transfer object holding portion R are of a specification in which they are directly attached within the case 3 respectively. In other words, the transfer tool A cannot be used when the glue Tb is used up, that is, the transfer tape T wound around the unwinding spool SP1 is used up, and is thus of so-called disposable type. However, the present invention is not limited to such transfer tools A of disposable type, but it is possible to employ a specification in which the transfer object holding portion R is held as a separated inner case or the like such that the entire transfer object holding portion R held within the inner case can be exchanged as a refill.

As shown in FIGS. 1 and 2, the cover 2 is, for instance, an integrally molded article made of rosin, and is comprised of a tip end portion having a shape capable of covering the above-described transfer head H and a base end portion that is supported by the case in a rotating manner. As particularly shown in FIGS. 3 and 4, the base end portion is arranged such that a rotating shaft 21 projects from both sides so as to pinch the case 3 from outside. Note that while the cover is attached such that the base end portion of the cover 2 pinches the case 3 from both sides by utilizing the elasticity of resin in the present embodiment, it is also possible to employ a structure for the case 2 and the cover 3 in which the rotating shaft 21 is made to project from inside to outside for attaching the same to the case 3 by similarly utilizing the elasticity of resin.

Accordingly, the transfer tool A according to the present embodiment is provided with latching means Y capable of suitably latching the cover 2 with respect to the transfer tool main body 1 both in the open position O and the closed position C as shown in FIG. 2 proximate of the above-described rotating shaft 21.

A concrete structure of the latching means Y will now be described in details on the basis of FIGS. 3(*a*), 3(*b*), 4(*a*) and 4(*b*).

The latching means Y is comprised of a concave portion 22 provided at the cover 2 proximate of the rotating shaft 21 and a convex portion provided on the case 3 side that may fit into the concave portion at a predetermined position.

In the present embodiment, there are provided two concaves 22*a*, 22*b* formed on the cover as the concave portion 22 wherein one concave 22*a* is provided at the base end of the cover 2 just like a notch while the other concave 22*b* is comprised as an aperture provided closer to the tip end than the rotating shaft 21.

On the other hand, a protrusion 32*a* projecting in a cylindrical manner to fit into the concaves 22*a*, 22*b* is provided as the convex portion 32. Note that the structure of the concave portion 22 and the convex portion 32 is not limited to such a structure alone but it is possible to provide the concave portion 22 on the case 3 side and the convex portion 32 on the cover 2 side. The concave portion is provided by a plurality of numbers concentrically around the rotating shaft 21 when seen in a plan view, wherein there are two of them disposed at two symmetric spots with respect to the rotating shaft 21 in the present embodiment.

Operations of latching the cover 2 with respect to the transfer tool main body 1 in the open position and the closed position by means of the above-described latching means Y will now be explained in details.

Figure 3:
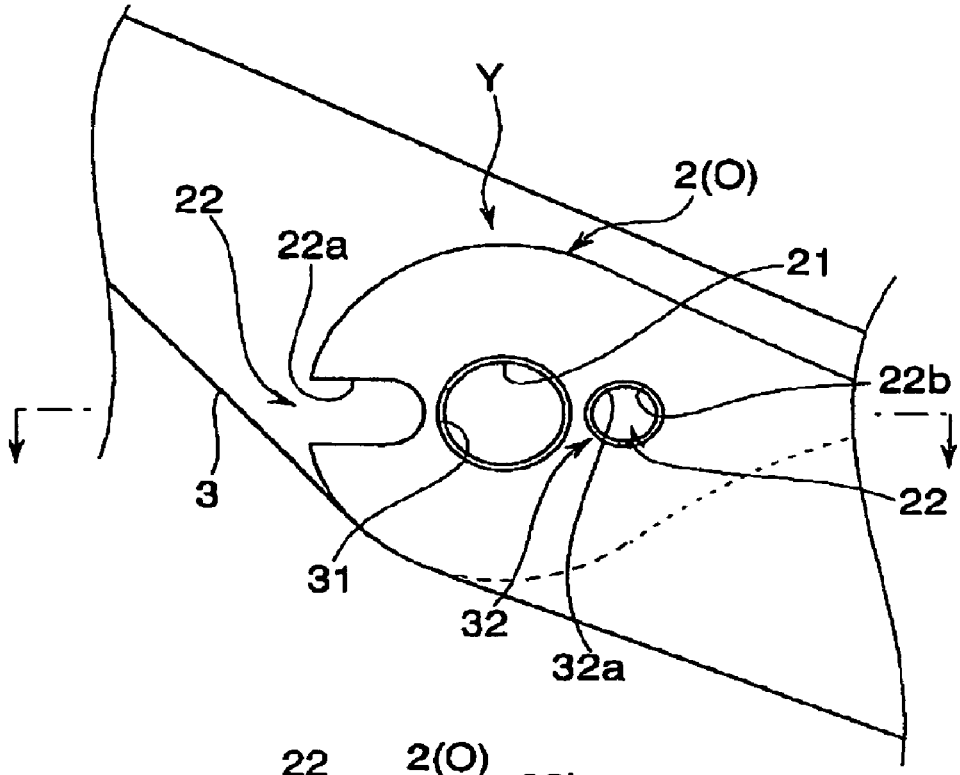
FIG. 3 is an explanatory view of operations related to the above embodiment.
Figure 3:
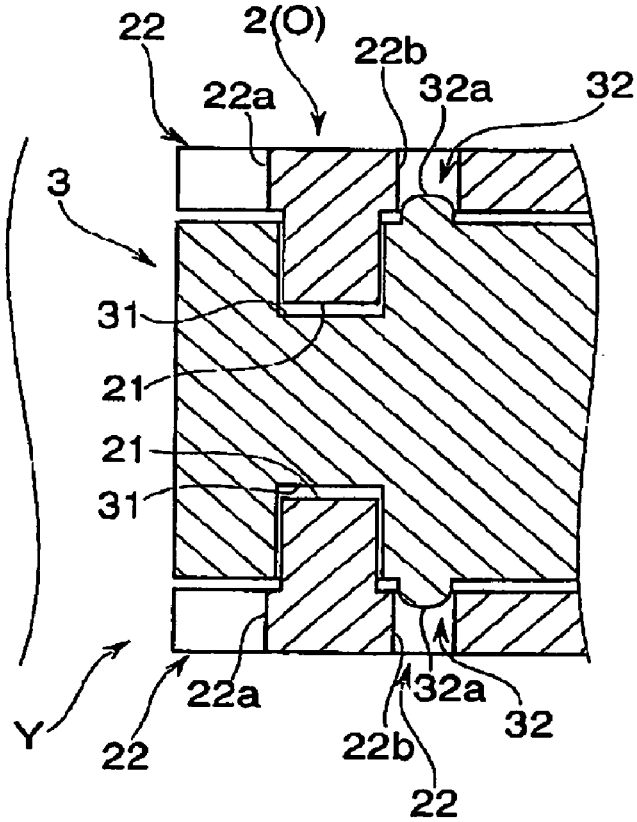

In the open position O as shown in FIG. 3, the cover 2 is in a stably latched condition with the protrusion 32*a* fitting into the other concave 22*b* provided at the cover 2.

Figure 4:
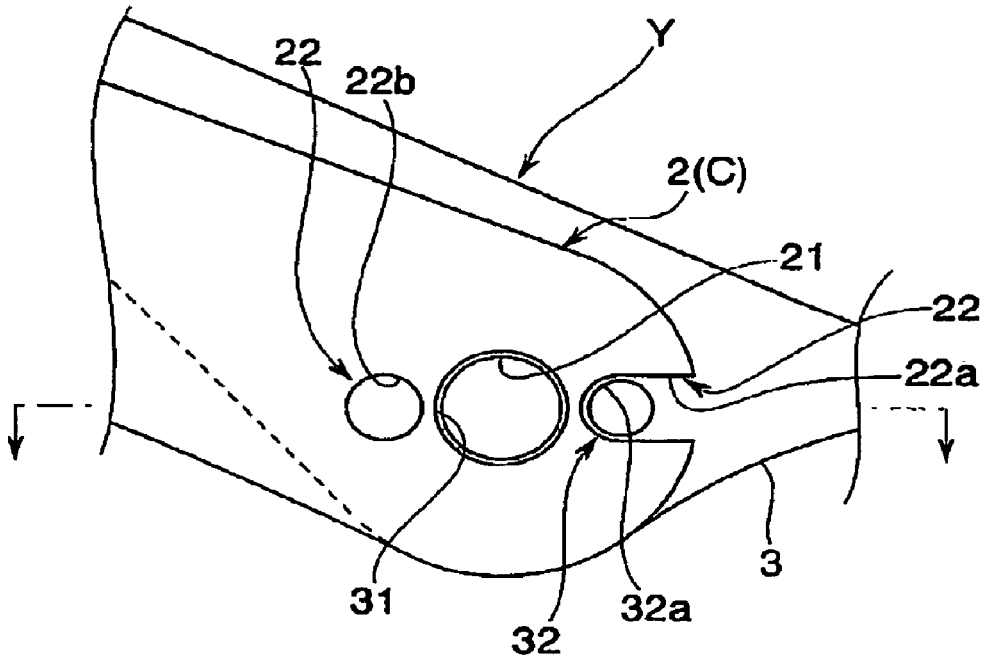
FIG. 4 is an explanatory view of operations related to the above embodiment.
Figure 4:
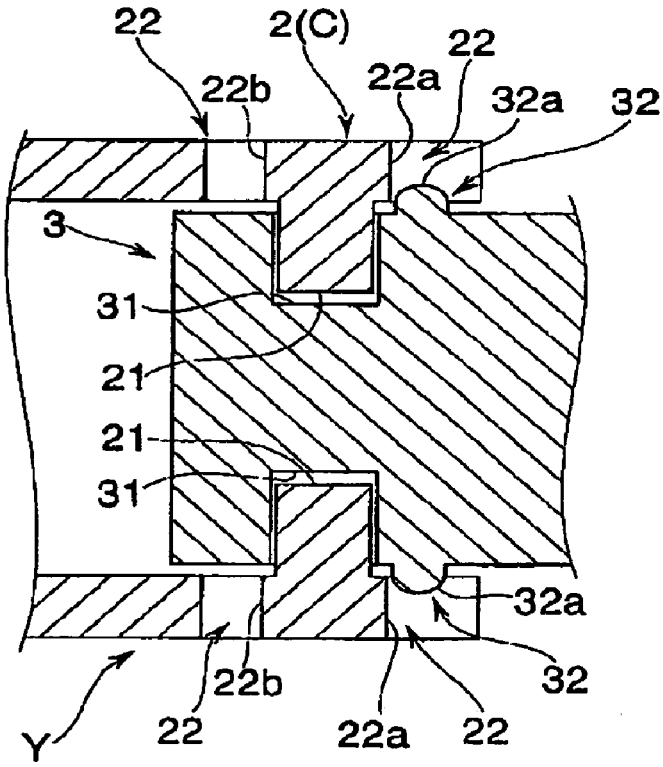

On the other hand, when the cover 2 is rotated by 180 degrees from the open position O, it assumes the closed position C as shown in FIG. 4. In the closed position C, the protrusion 32*a* comprising the convex portion 32 is in a condition in which it is fitted into the one concave 22*a* provided at the cover 2, the cover 2 is latched at the closed position C.

In addition thereto, in a condition in which the cover 2 is rotating between the open position O and the closed position C, the tip end of the protrusion 32*a* is slidably moved while abutting the surface of the cover 2, but thanks to the arrangement that the base end portion on both sides of the cover 2 opens through elasticity exhibited by the cover 2 made of resin and to the friction between the tip end of the protrusion 32*a* and the case 2, the usability will be favorable for users.

With the above-described configuration, the transfer tool A employing the latching structure X of the cover 2 according to the present embodiment is characterized in that the latching means Y that latches the cover 2 with respect to the case 3 of the transfer tool main body 1 is provided proximate of the rotating shaft 21 around which the cover 2 rotates.

With such configuration, by providing the latching means Y proximate of the rotating shaft 21 (which the supporting body 1 and the cover 2 at least contact for attaching both in a rotating manner), it will be possible to effectively avoid the necessity of providing a particular means for maintaining the position of the cover 2 at different spots of the cover 2 and the case 3. With such configuration, specifications for the case 3 and the cover 2 of the supporting body 1 other than that of the location of the rotating shaft 21 will not be limited, and the flexibility of design for arranging the cover 2 and the case 3 can be suitably improved.

By comprising the latching means Y by the concave portion 22 and the convex portion 32 provided proximate of the rotating shaft 21 such that the latching means Y is provided at a different spot than the rotating shaft 21, it is possible to certainly position the cover 2 while stabilizing operations of the rotating shaft 21.

Moreover, by comprising the concave portion 22 of concaves 22*a*, 22*b* disposed by a plurality of numbers concentrically around the rotating shaft 21 when seen in a plan view, it is possible to determine a plurality of positions of latching the cover 2, that is, the open position O and the closed position C, by means of a simple structure.

Further, by arranging the case 3 and the cover 2 that comprise the transfer tool main body 1 of resin, it is possible to effectively use bending, which is a characteristic of resin material, for suitably latching the cover 2 and also easily unlatching the same from the latched condition such that the cover 2 may be rotated.

Figure 5:
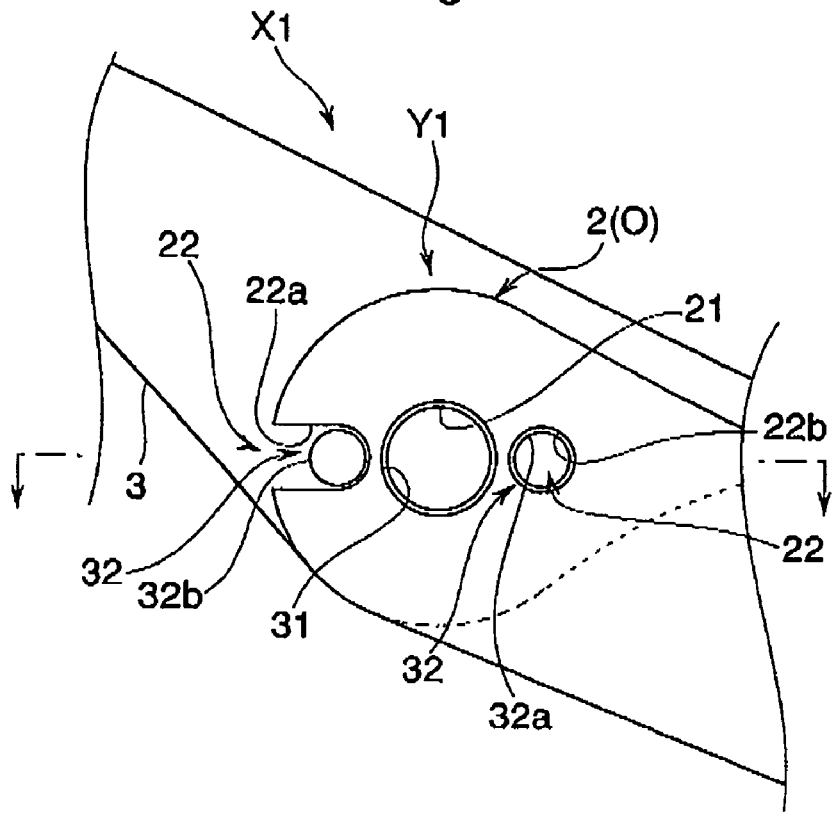
FIG. 5 is an explanatory view of operations related to a modified example of the above embodiment.
Figure 5:
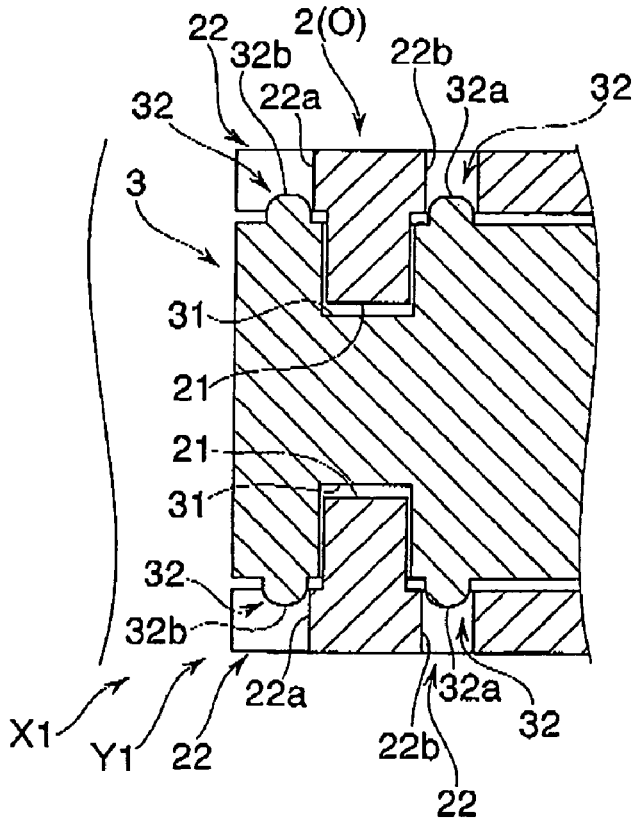
Figure 6:
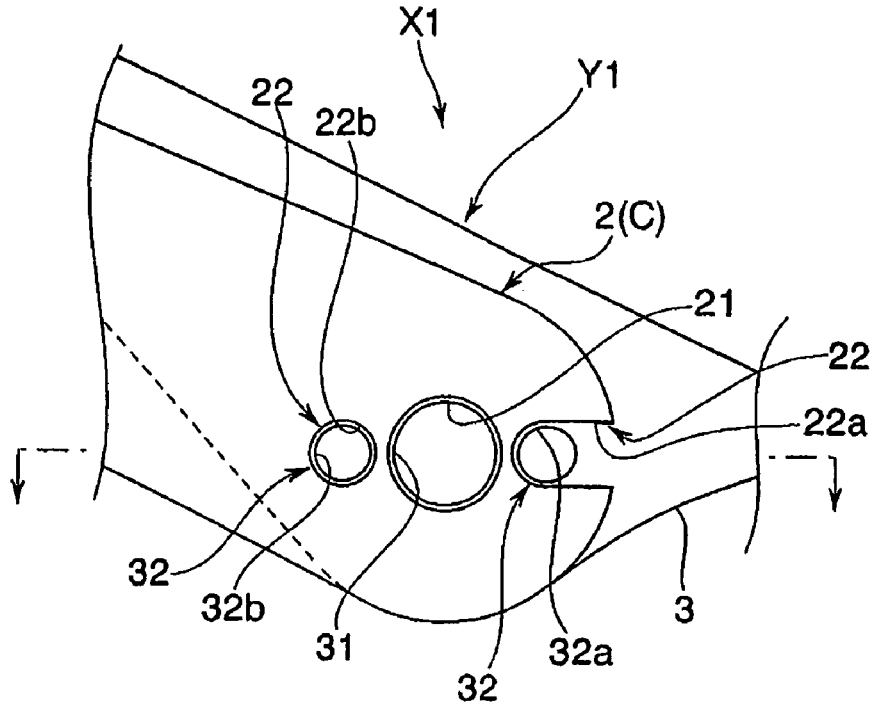
FIG. 6 is an explanatory view of operations related to a modified example of the above embodiment.
Figure 6:
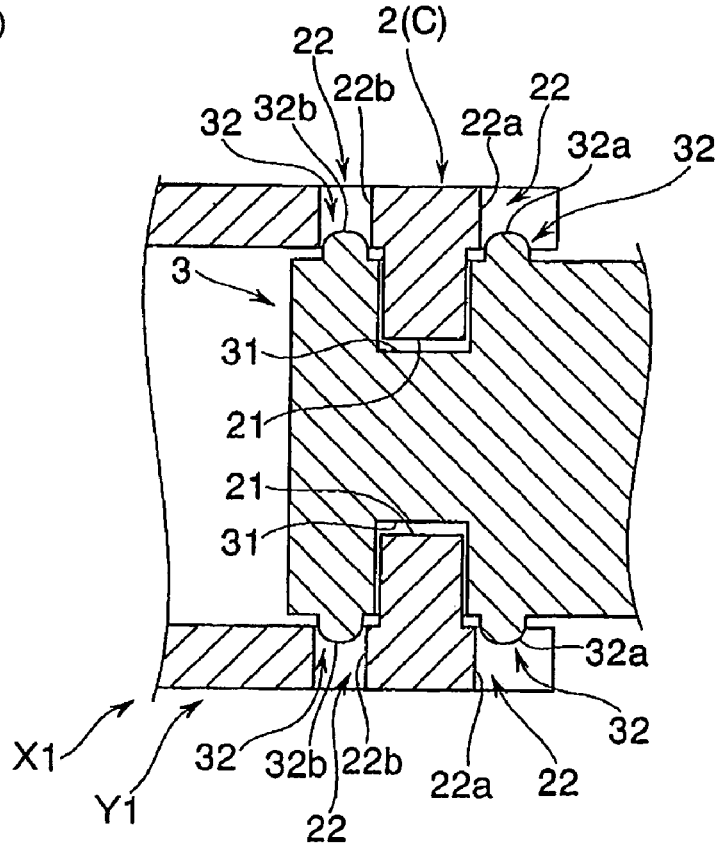

A transfer tool A employing a cover latching structure X1 will now be explained as a modified example of the present embodiment with reference to FIGS. 5(*a*), 5(*b*), 6(*a*) and 6(*b*).

In the present modified example, the transfer tool A is comprised of a transfer tool main body 1 corresponding the supporting body and a cover 2, similarly to the above embodiment. Since the concrete structure of the cover 2 is substantially the same as that of the above embodiment, the same reference numerals are used and detailed explanations thereof omitted; however, the case 3 includes, around its bearing 31, two protrusions 32*a*, 32*b* that may fit into the concave 22*a* as shown in FIG. 5. More particularly, latching means Y1 of the present modified example is comprised of two concaves 22*a*, 22*b* and two protrusions 32*a*, 32*b*.

With such configuration, the cover 2 can be latched at a plurality of spots, that is, two spots with respect to the case 3 in the open position O and the closed position C as shown in the drawings so that the position of the cover 2 can be more certainly maintained.

A latching structure X2 for a cover 2A provided at a inclined shaft 21A corresponding the rotating shaft will now be explained in details with reference to FIGS. 7 and 8 as a second embodiment of the present invention.

Figure 7:
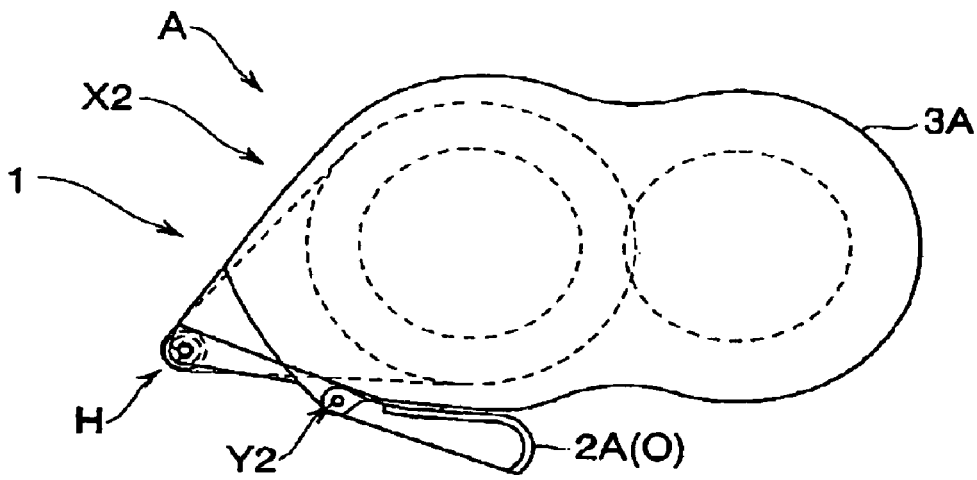
FIG. 7 is an explanatory view of operations related to a second embodiment of the present invention.
Figure 7:
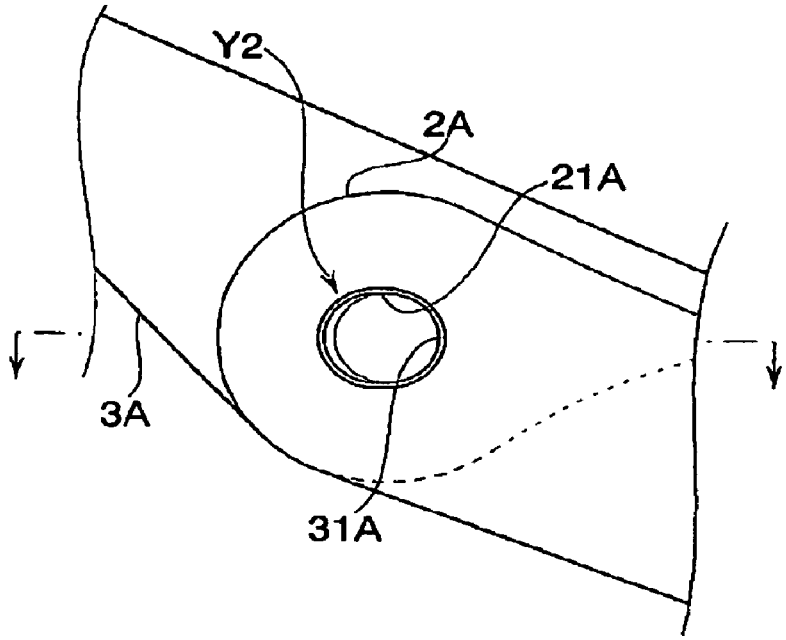
Figure 7:
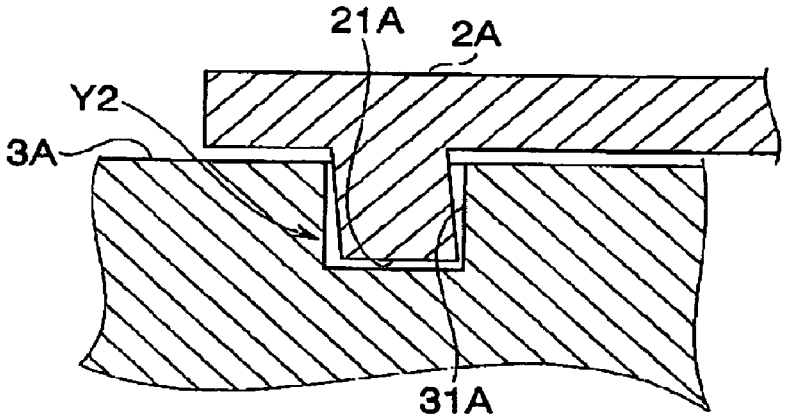
Figure 8:
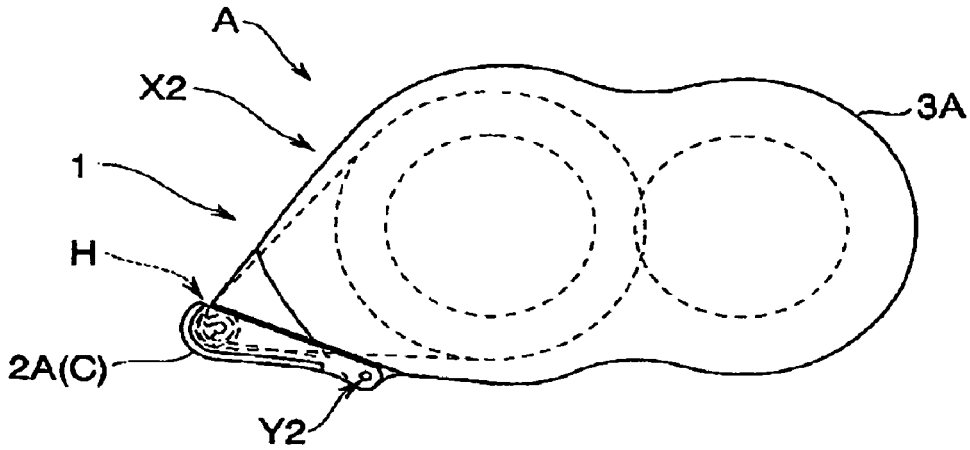
FIG. 8 is an explanatory view of operations related to a second embodiment of the present invention.
Figure 8:
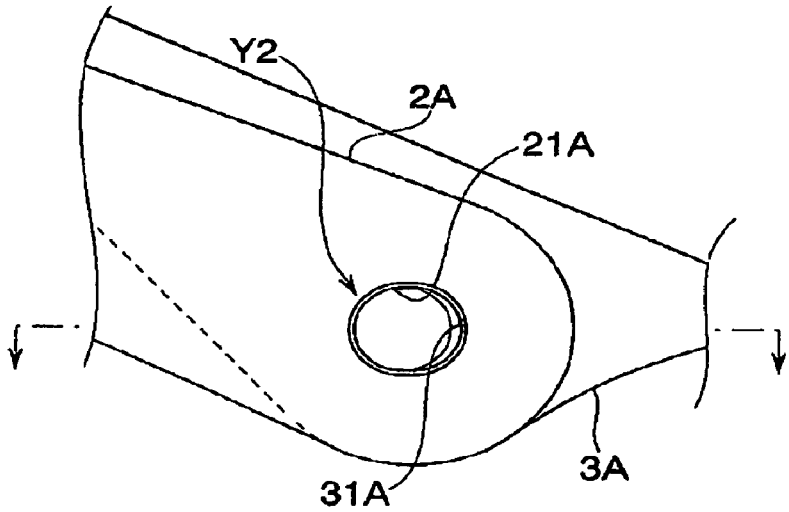
Figure 8:
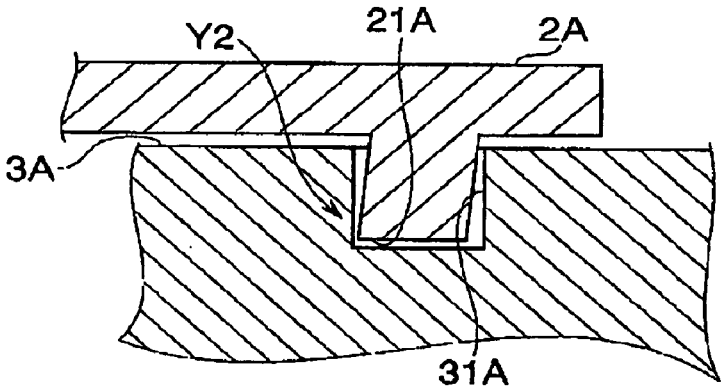

In the present embodiment as shown in FIGS. 7(*a*) and 8(*a*), the latching means Y2 for latching the cover 2A with respect to the case 3 in the open position O and the closed position C is provided at a portion of the inclined shaft 21A that serves as a rotating shaft around which the case 2A rotates.

That is, as shown in FIGS. 7(*b*), 7(*c*), 8(*b*), 8(*c*), the latching means Y2 is comprised of the inclined shaft 21A provided at the cover 2A and extending to deflect towards a predetermined direction in a plan view, and an elongated hole 31A provided at the case 3 and accommodating inclined shaft 21A and latched at a predetermined position at which a inclined direction of the inclined shaft 21A and a longitudinal direction of the elongated hole 31A coincide, that is, at which the cover 2A is latched with respect to the case 3A in a condition in which the cover 2A is in the open position O or in the closed position C.

More particularly, the inclined shaft 21A shall be set to project while inclined such that a phase shift of 5% to 50% with respect to the diameter of the inclined shaft 21A is present from between a base end rising from the cover 2A towards a tip end thereof, and a shorter-dimensioned size of the elongated hole 31A of a direction that is orthogonal to the longitudinal direction thereof shall be set to be larger than the diameter of the inclined shaft 21A by 5% to 50% of the diameter of the inclined shaft 21A. That is, when the tip end portion of the inclined shaft 21A and the elongated hole 31A are in partial contact with each other so as to expand the width dimension of the elongated hole 31A to result in a substantial coincidence of the inclined direction of the inclined shaft 21A and the longitudinal direction of the elongated hole 31A, the inclined shaft 21A and the elongated hole 31A will be in partial contact so that suitable latching is achieved in the open position O and the closed condition C as shown in the drawings. On the other hand, when the user rotates the cover 2A, one of both are elastically deformed such that the shorter-dimensioned size of the elongated hole 31A is expanded or the inclined dimension of the inclined shaft 21A becomes smaller, whereby the user will sense a suitable amount of resistance.

With such configuration, the cover 2A may be latched with respect to the case 3A by the structure of the spot of the inclined shaft 21A, and the flexibility of design of other parts of the cover 2A and the case 3A is increased.

While embodiments of the present invention have been explained so far, particular structures of respective parts are not limited to those of the above-described embodiment but may be varied in a variety of ways without departing from the spirit of the present invention.

Figure 9:
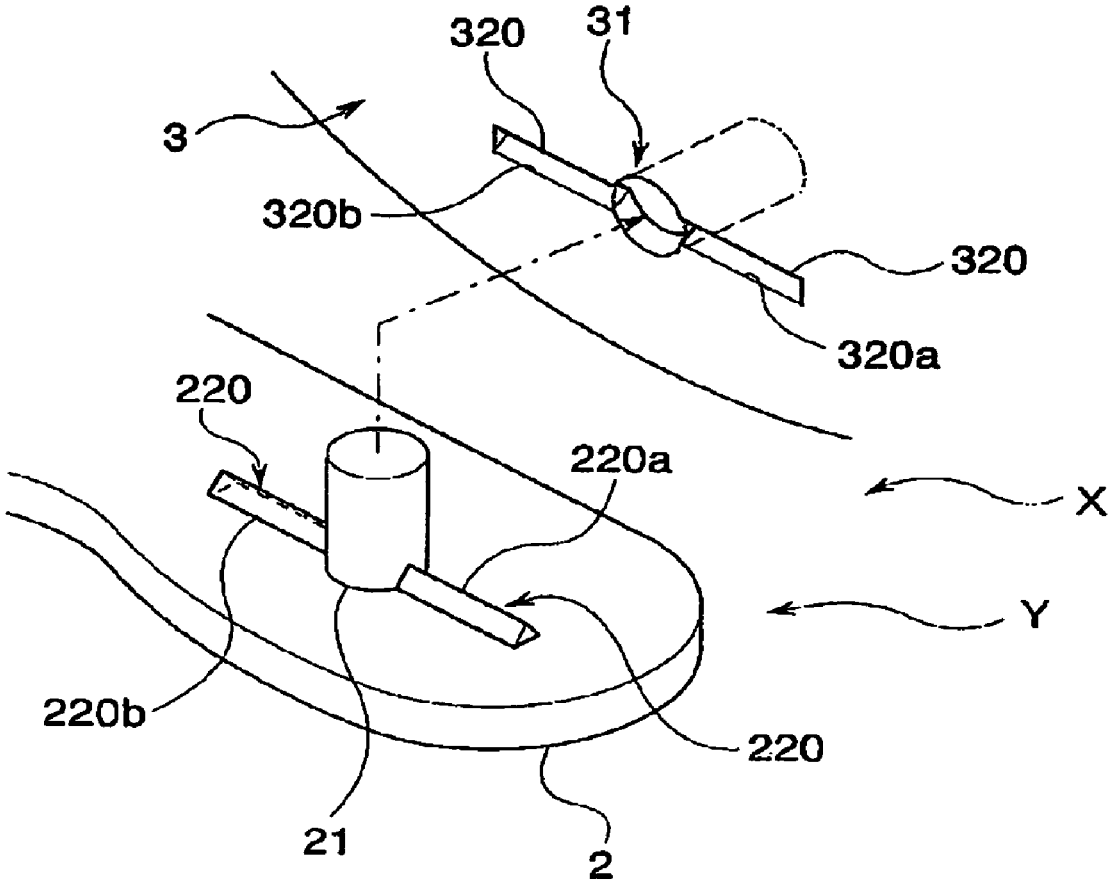
FIG. 9 is a schematic view related to another modification of the first embodiment of the present invention.

For instance, in the above-described first embodiment, while the concave portion 22 and the convex portion 32 were set as the protrusion 32*a* and concaves 22*a*, 22*b*, they are not limited to the protrusion 32*a* and concaves 22*a*, 22*b* alone. More particularly, as shown in FIG. 9, it is also possible to employ an latching structure X including latching means Y in which a concave portion 320 and a convex portion 220 are comprised of two ribs 220*a*, 220*b* formed on the rotating shaft 21 on the cover 2 side in an adjoining manner and two grooves 320*a*, 320*b* formed successively on the bearing on the case 3 side. Further, in the first embodiment, while the one concave 22*a* was formed as a notch having a laterally-facing U-shaped form provided at the cover 2, it is also possible to form a notch of elongated circular shape or of round circular shape.

Moreover, the structure may be a combination of the latching means comprised of the concave portions and convex portion as employed in the first embodiment and the latching means comprised of the inclined shaft and the elongated hole as employed in the second embodiment. In addition thereto, the concave portion, the convex portion, the rotating shaft and the bearing may be provided on one of the case side and the cover side. More particularly, it is possible to provide the rotating shaft on the case side and the bearing on the cover side, or to provide the concave portion on the case side and the convex portion on the cover side.

Concrete structures of respective remaining portions are not limited to the above embodiments alone but may be varied in a variety of ways without departing from the spirit of the present invention.

What is claimed is:

1. A transfer tool comprising:

a transfer tool main body including a case and a transfer head for applying tape;

a cover housing a rotating shaft configured to engage the case and enable the cover to rotate about the rotating shaft such that the transfer head is exposed when the cover is in an open position and the transfer head is covered by the cover in a closed position; and a latching means for latching the cover and the transfer tool main body, wherein the latching means is located proximate to the rotating shaft and includes a complementary concave and convex portions, one of the concave and convex portions being housed on the transfer tool main body and the other of the pair of concave and convex portions being housed on the cover, the convex portion being configured to fit into the concave portion so as to latch the cover to the transfer tool main body when the cover is in the open position;

wherein the latching means is configured so that the cover can be latched to the transfer tool main body when the cover is in either the open position or the closed position.

2. The transfer tool of claim 1, wherein the latching means is comprised of a concave portion that is housed on the cover proximate to the rotating shaft and a convex portion housed on the case proximate to the rotating shaft.

3. The transfer tool of claim 1, wherein a plurality of concave portions are disposed proximate to and concentrically around the rotating shaft.

4. The transfer tool of claim 3, further comprising a plurality of the convex portions, wherein the plurality of convex portions are arranged to respectively fit into the plurality of concave portions.

5. The transfer tool of claim 1, wherein the transfer tool main body and the cover are made of resin.

6. The transfer tool of claim 1, wherein the latching means includes a plurality of concave portions and a plurality of convex portions and wherein the cover is latched to the transfer tool main body in a varied position based upon which of the plurality of convex portions is fit into each of the respective plurality of concave portions.

7. The transfer tool of claim 1, wherein the convex portion is a protrusion housed on the transfer tool main body and wherein the concave portion is a cut-out in the cover.

8. The transfer tool of claim 7, wherein the convex and concave portions are fit together by a pinch fit.

9. The transfer tool of claim 1, wherein both the transfer tool head and the rotating shaft are internally housed within the cover when the cover is in the closed position.

10. The transfer tool of claim 1, wherein the rotating shaft is comprised of a pair of projections configured and aligned to pinch the cover between the pair of projections and configured to permit the cover to rotate about the rotating shaft.

11. The transfer tool of claim 1, further comprising a winding spool and an unwinding spool housed internally within the transfer tool main body, wherein the cover and latching mechanism are configured such that the winding spool and unwinding spool are internally housed within the transfer tool main body when the cover is in the open and closed positions.

12. A transfer tool comprising:

a transfer tool main body including a case and a transfer head for applying tape;

a cover housing a rotating shaft configured to engage the case and enable the cover to rotate about the rotating shaft such that the transfer head is exposed when the cover is in an open position and the transfer head is covered by the cover in a closed position; and a latching means for latching the cover and the transfer tool main body, wherein the latching means is located proximate to the rotating shaft and includes two pairs of complimentary concave and convex portions, one of either the concave portions or the convex portions being housed on the transfer tool main body and the other of the concave portions and the convex portions being housed on the cover, the convex portions being configured to fit into the concave portions so as to latch the cover to the transfer tool main body in at least one of the open and closed positions.

* * * * *